United States Patent [19]

Aguilar

[11] 4,235,031

[45] Nov. 25, 1980

[54] INDEX TAB AND METHOD OF MAKING SAME

[76] Inventor: Henry Aguilar, 61 Garcia Ave., San Francisco, Calif. 94127

[21] Appl. No.: 967,216

[22] Filed: Dec. 7, 1978

[51] Int. Cl.[3] ..... B42F 21/00

[52] U.S. Cl. ..... 40/360; 281/42

[58] Field of Search ..... 281/42; 116/234, 237; 40/158 A, 360

[56] References Cited

U.S. PATENT DOCUMENTS

| | | | |
|---|---|---|---|
| 538,706 | 5/1895 | Sexton | 116/234 |
| 1,672,113 | 6/1928 | Catherman | 40/158 A X |
| 1,919,971 | 7/1933 | Wulkop | 116/234 |
| 1,921,213 | 7/1933 | Bush et al. | 40/2 X |
| 2,622,055 | 12/1952 | Lieder | 40/158 A X |
| 3,298,714 | 1/1967 | Celmer | 116/234 |

FOREIGN PATENT DOCUMENTS

| | | | |
|---|---|---|---|
| 1941496 | 8/1969 | Fed. Rep. of Germany | 40/158 A |

*Primary Examiner*—F. Barry Shay
*Assistant Examiner*—Wenceslao J. Contreras
*Attorney, Agent, or Firm*—Thomas Schneck

[57] ABSTRACT

An index tab is disclosed which attaches over a corner of a sheet or several sheets of paper. The tab includes a tubular body which has a paper enclosing portion receptive to a triangular corner portion of the sheets of paper and a projecting portion which projects from an edge of the sheets of paper. The index tab is attached to the papers by means of a single staple which penetrates both the paper enclosing portion of the body and the corner of the sheets of paper so that the same staple which holds the paper together, also attaches the index tab thereto.

2 Claims, 10 Drawing Figures

INDEX TAB AND METHOD OF MAKING SAME

BACKGROUND OF THE INVENTION a. Field of the Invention

This invention relates generally to marking or flagging devices for papers or similar articles and more particularly to index tabs adapted to be permanently or semi-permanently attached to one or more sheets of paper and a method of making same.

b. Prior Art

Index tabs are attached to one or more sheets of paper in order to organize those papers into a quickly recognizable group, to allow those papers to be index labeled and to "flag" a sheet or a few sheets of paper to indicate priority or special handling.

A problem not satisfactorily addressed by the prior art is how to produce an index tab that will not rip off of or tear the paper to which it is attached when the tab is handled roughly or carelessly. Another problem not addressed is how to produce an index tab which is attached by a staple to multiple sheets of paper, the staple holding the tab and sheets together at a common corner, in a manner such that the tab will not interfere with the normal turning of the pages.

SUMMARY OF THE INVENTION

An object of this invention is to provide an index tab which, when attached to one or more sheets of paper by a staple, does not tend to rip off or tear the paper even under rough and careless handling.

Another object of this invention is to provide an index tab which, when attached to a number of sheets of paper by the same staple that holds the sheets of paper together, will not interfere with the normal turning of the pages.

Yet another object of this invention is to provide an index tab which strengthens and reinforces the stapled attachment of a number of sheets of paper together.

A still further object of this invention is to provide the above mentioned objects wth an index tab that is simple and inexpensive to construct, easy to use, and which is attractive and long-lasting.

Briefly, the index tab of this invention includes a body formed from a semi-rigid material, such as construction paper, that is penetrable by the legs of an ordinary staple and which has a tubular portion receptive to a triangularly shaped corner section of one or more sheets of paper and a projecting portion which projects from an edge of those sheets of paper. In use, the tubular portion is slipped over a common corner of the sheets of paper and then stapled thereto so that the staple joins the tab and sheets together. The projecting portion creates an easily recognizable tab for the stapled together sheets of paper.

An advantage of this invention is that its simple construction from a relatively inexpensive material allows the production of an extremely inexpensive index tab.

Another advantage of this invention is that since the tubular portion covers only a triangular corner section of the sheets of paper, the papers may be turned freely and without encumbrance.

Yet another advantage of this invention is that the attachment of the index tab to the sheets of paper actually strengthens rather than weakens the attachment of the sheets of paper together.

These and other objects and advantages of the present invention will no doubt become apparent after a reading of the following detailed description and a study of the several figures of the drawing.

Figure 5:
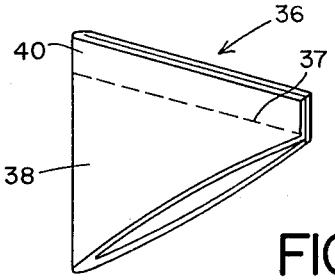
FIG. 5 illustrates an alternate embodiment of an index tab in accordance with the present invention.

FIG *5a* illustrates the construction of the index tab shown in FIG. 5.

Figure 6:
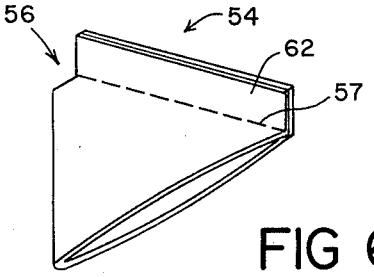

FIG. 6 is a perspective view of another alternate embodiment of an index tab in accordance with the present invention.

FIG. *6a* illustrates the construction of the index tab shown in FIG. 6.

Figure 7:
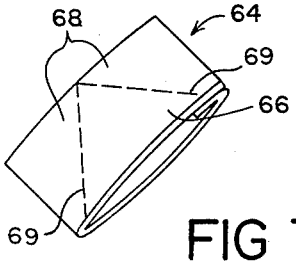

FIG. 7 is a perspective view of yet another alternate embodiment of an index tab in accordance with the present invention.

FIG. *7a* illustrates the attachment of the index tab shown in FIG. 7 to the corner of a couple of sheets of paper.

DESCRIPTION OF THE PREFERRED EMBODIMENT

Figure 1:
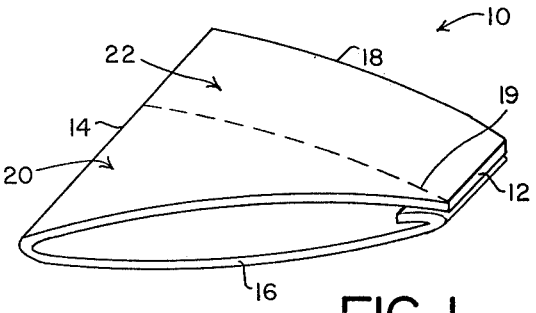
FIG. 1 is a perspective view of an index tab in accordance with the present invention.
Figure 2:
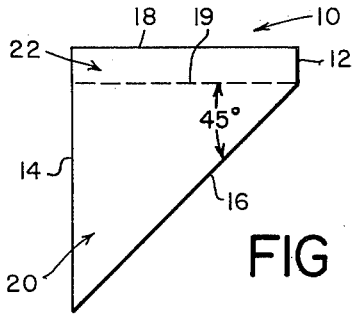
FIG. 2 is a top plan view of the index tab shown in FIG. 1.

Referring to the perspective view of FIG. 1 and the top plan view of FIG. 2, a preferred embodiment of an index tab is shown to include a body 10 that is substantially trapezoidal in shape in that it has two parallel sides 12 and 14 and two non-parallel sides 16 and 18. Non-parallel side 18 is at substantially right angles to parallel sides 12 and 14, and non-parallel side 16 is angled at approximately 45° with respect to the parallel sides, although this angle is not critical. The body may be tought of as being functionally if not physically divided by a broken line 19 into a flattened tubular portion 20 that is receptive to a triangularly shaped corner section of one or more sheets of paper and a projecting portion 22 which normally projects beyond an edge of the sheets of paper.

The triangularly shaped corner should be large enough to receive a staple. For example if the triangle is a right angle triangle, the sides adjacent to the right angle, 14 and 19 may be about 3 cm. each. The side 12 may be about one cm. in length and the side 16 may be about 4.7 cm. in length. These dimensions are exemplary only and the triangle need not be a right angle triangle, although this is preferred.

Figure 3:
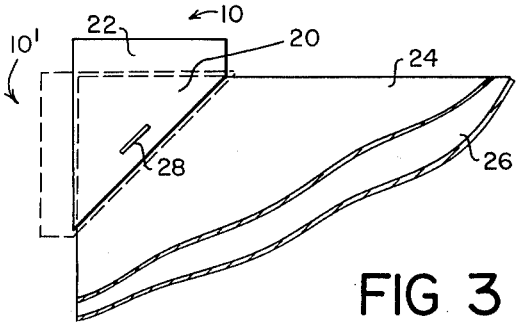
FIG. 3 illustrates the attachment of the index tab of FIG. 1 to the upper left hand corner of a pair of sheets of paper.

Referring now to FIG. 3, the body 10 of an index tab is shown to be attached to two sheets of paper 24 and 26 by a staple 28. The common upper left corners of the sheets of paper are inserted into the tubular portion 20 of the body so that the projecting portion 22 extends upwardly from the edge of the papers. The tab strengthens the staple attachment of the sheets of paper and provides a convenient index tab for the papers thus attached.

As shown at 10', the same index tab may also be attached so that the projecting portion projects from a side edge of the sheets of paper. The attachment of the index tab to the papers in either position can be accomplished by the same staple 28 that holds the sheets of paper together.

Figure 4:
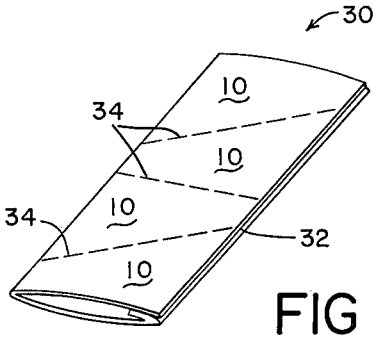
FIG. 4 illustrates one production method for making the index tab shown in FIGS. 1, 2 and 3.

One production method that can quickly and economically produce the index tab illustrated in FIGS. 1, 2 and 3 can be discussed with reference to FIG. 4. With this production method, a sheet of material is rolled into a tube 30 by adhesively attaching its longer edges together as shown at 32. The tube is then flattened and cut along dotted lines 34 to produce the bodies 10 of a plurality of index tabs.

In FIG. 5, an alternate embodiment for an index tab has a body 36 which, like the previous embodiment, is generally trapezoidal in shape. The body is functionally divided by a broken line 37 to form a tubular portion 38 that is receptive to a corner of one or more sheets of paper and a projecting portion 40 which projects from an edge of the sheet or sheets of paper. In this embodiment, projecting portion 40 is adhesively attached together along its length.

Figure 5A:
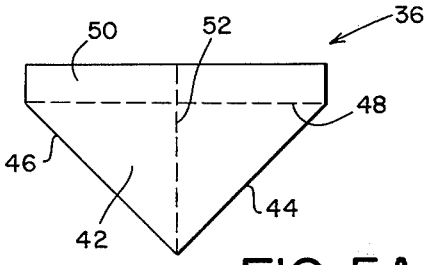

In FIG. 5*a*, the construction of the index tab shown in FIG. 5 is illustrated. Body 36 is constructed from a piece of a sheet of material having a portion 42 shaped like an isosceles triangle in that it has two sides 44 and 46 of equal length and an unequal lengthed side 48, and a portion 50 shaped like a rectangle having a length equal to that of side 48. When folded along a mid-length fold line 52, triangular portion 42 forms tubular portion 38, rectangular portion 50 forms projecting portion 40, and side 48 corresponds to broken line 37.

Figure 6A:
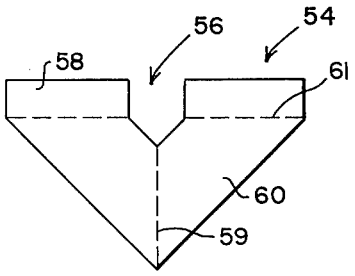

In FIG. 6, an index tab having a body 54 is illustrated that greatly resembles the index tab illustrated in FIG. 5 with the exception of the removal of a portion 56 from the body. Again a broken line 57 is used to indicate the separation of the body into a tubular portion and a projecting portion. As seen in FIG. 6*a*, removed portion 56 is created by removing a part of rectangular section 58 and a part of triangular section 60. The body is then folded along a fold line 59 so that broken line 61 corresponds to broken line 57. Thus, the projecting portion 62 of an index tab can be modified in shape to permit an increase in the number of sheets which may fit inside the tab. This projecting portion 62, like projecting portion 40 in FIG. 5, is similar to the projecting portion 40 of FIG. 5, and is adhesively closed along its length.

In FIG. 7, another alternate embodiment for an index tab is shown to include a body 64 having a tubular portion 66 and a projecting portion 68, which may or may not be tubular, that are functionally separated by broken lines 69. In this embodiment body 64 is substantially rectangular in shape.

Figure 7A:
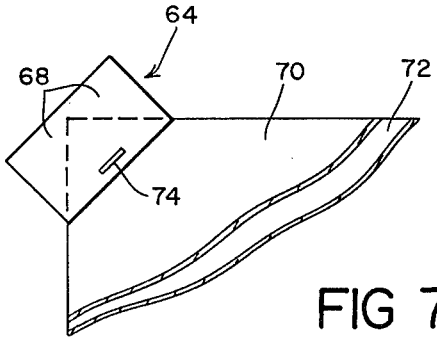

In FIG. 7*a*, the body 64 of the index tab is shown to receive a triangular corner section of two sheets of paper 70 and 72. The index tab is held in place by a single staple 74, which also holds the sheets of paper together. Note that in this embodiment that projecting portion 68 extends both to the top and to the side edges of sheets of paper 70 and 72.

A preferred material of construction for the above described index tabs would be a medium to heavy grade construction paper. The adhesive attachment of the edges of the paper could then comprise the inexpensive and readily available white glue. Furthermore, various colors of construction paper could be used to distinguish tabs from one another.

While this invention has been described in terms of several preferred embodiments, it is contemplated that various alterations and modifications thereof will become apparent to those skilled in the art after they have studied this disclosure. For instance, it is readily apparent that there are numerous alternate methods for the construction of the index tabs herein described. Furthermore, the material of construction need not be limited to construction paper but could also include suitable plastics, such as vinyl plastic, or could be constructed of a paper/plastic or other hybrid material.

It is therefore intended that the following appended claims be interpreted as including all such alterations and modifications as fall within the true spirit and scope of this invention.

What is claimed is:

1. An index tab for attachment to at least one sheet of paper comprising, a generally flat, tubular body having a lengthwise seam, the body being trapezoidal in shape with two opposed, closed parallel sides of unequal length aligned with the body seam and two non-parallel ends transverse to said sides, with at least one of said ends being open, said body having a paper enclosing portion receptive to a triangular corner of a sheet of paper at said open end and a projecting body portion which projects outwardly from an edge of said sheet of paper, a portion of the longer of said two parallel sides being coextensive with a side of said triangular corner, but the shorter of said parallel sides preventing said triangular corner from entering said projecting body portion.

2. The index tab of claim 1 wherein said rectangular outwardly projecting portion is adhesively closed.

* * * * *